United States Patent [19]

Allen

[11] Patent Number: 4,968,998

[45] Date of Patent: Nov. 6, 1990

[54] REFILLABLE INK JET PRINT SYSTEM

[75] Inventor: Ross R. Allen, San Diego, Calif.

[73] Assignee: Hewlett-Packard Company, Palo Alto, Calif.

[21] Appl. No.: 385,628

[22] Filed: Jul. 26, 1989

[51] Int. Cl.[5] ..... B41J 2/175

[52] U.S. Cl. ..... 346/140 R

[58] Field of Search ..... 346/75, 140 PD

[56] References Cited

U.S. PATENT DOCUMENTS 4,187,511 2/1980 Robinson ..... 346/75

4,714,937 12/1987 Kaplinsky ..... 346/140 PD

*Primary Examiner*—George H. Miller, Jr.

[57] ABSTRACT

An ink jet print cartridge liquid toner container (14) is refillable at a service station (60) in a printer (50). Liquid toner is forced into the liquid toner container (14) from a liquid toner reservoir (70) through a refill tube (26) extending into the interior of the foam-filled container (14). Simultaneously, a volume of air and toner is withdrawn from the upper portion of the foam (20) through an evacuation tube (30) at a rate equal to or greater than the refill rate. Typically, a portion of the volume of foam (20) is filled with air so that the foam (20) fills with toner as air is removed.

18 Claims, 2 Drawing Sheets

REFILLABLE INK JET PRINT SYSTEM

This invention relates to an ink jet printer system, and, more particularly, to such a system wherein the liquid toner container of the print cartridge is refillable during service.

Printers are devices that print images onto a printing medium such as a sheet of paper or a polyester film. Printers of many types are available and are commonly controlled by a computer that supplies the images in the form of text or figures, that are to printed.

To form the image, some printers use a liquid toner, which may be a dye dissolved in, or pigment suspended in, a colorless carrier called a "vehicle". This liquid toner is often termed an "ink" in the printer industry. Such printers deliver the liquid toner to the medium using a print cartridge that creates the proper patterning of liquid toner to permanently record the image on the printing medium. (By contrast, other printers use a dry toner to form the image.)

One important type of printer is the ink jet printer, which forms small droplets of ink that are ejected toward the printing medium in a pattern of dots that form the images. When viewed at a distance, the collection of dots form the image in much the same manner that photographic images are formed in newspapers. Ink jet printers are fast, produce high quality printing, and are quiet, because there is no mechanical impact during formation of the image, other than the droplets of liquid toner striking the printing medium.

Typically, an ink jet printer has a large number of individual ink-ejection nozzles in the print cartridge, which is supported in a carriage and oriented in a facing, but spaced-apart, relationship to the printing medium. The carriage and supported print cartridge traverse over the surface of the medium with the nozzles ejecting droplets of liquid toner appropriate times under command of the computer or other controller to produce a swath of droplets.

In the thermal ink jet printer, the ejection of droplets is accomplished by heating a volume of the liquid toner adjacent the nozzle with a resistor, thereby vaporizing a bubble of the liquid toner to drive the droplet toward the printing medium. The droplets strike the medium and then dry to form "dots" that, when viewed together, form one swath or row of the permanently printed image. The carriage is moved an increment in the direction perpendicular to the traverse (or, alternatively, the printing medium is advanced), and the carriage again traverses the page with the print cartridge operating to deposit another swath. In this manner, the entire pattern of dots that form the image is progressively deposited by the print cartridge during a number of traverses of the page. To achieve the maximum output rate, the printing is preferably bidirectional, with the print cartridge ejecting liquid toner during traverses from left-to-right and right-to-left.

The liquid toner may be stored in a foam-filled liquid toner container that, for some types of printers, is mounted on the carriage adjacent the nozzles. Liquid toner is then delivered by capillary action to the nozzles for ejection. It is common for some printers that the print cartridge is a single consumable and disposable unit, which may be readily inserted and removed from the printer when the liquid toner in the container is exhausted or one or more of the nozzles malfunction.

The useful expected life of the disposable thermal ink jet print cartridge is established by a concern for overall reliability based upon the time at which a nozzle failure is expected to occur. In recent years, the design and manufacture of the nozzles, resistors, and associated apparatus of the print cartridge have advanced, so that the useful expected life of the print cartridge prior to failure has lengthened significantly. There now exists a need for a larger supply of liquid toner available for ejection that can conveniently be carried on board the printer.

The design of the liquid toner container of the print cartridge is sophisticated, because of the need to ship and store the cartridge and thereafter to deliver a flow of filtered liquid toner without leakage and at a controlled pressure under a variety of conditions such as different orientations of the print cartridge and use of the printer at different altitudes and temperatures. In one present approach, the liquid toner container is partially filled with a compliant open cell foam. Liquid toner is introduced into the foam during manufacture. The liquid toner is retained within the pores of the foam and is withdrawn over the life of the print cartridge. Filling the foam requires great care to avoid pockets of liquid toner that can leak, air pockets, and the introduction of defects into the foam that can cause irregular liquid toner flow.

Simply increasing the size of the foam and the liquid toner container is not an acceptable solution to the problem of providing a larger liquid toner supply, beyond reasonable limits. Too large a container results in poor pressure regulation, leakage, and shipping problems. Additionally, the cartridge and its ink supply are supported upon, and move with, the printer carriage. Increasing the size of the container would necessarily increase the size, strength, and cost of the structure that supports and moves the carriage. The performance of the printer would suffer, and its overall size and cost would increase.

There is a need for an approach for increasing the amount of liquid toner available for droplet ejection from a print cartridge, which does not increase the mass and size of the printer carriage. The approach should permit the desirable features of the present approach to providing liquid toner to be retained, provide more liquid toner, and not unduly increase the cost or complexity of the printer. The present invention fulfills this need, and further provides related advantages.

SUMMARY OF THE INVENTION

The present invention provides a printer, print cartridge, and approach for their operation that substantially increases the amount of liquid toner available for ejection by the print cartridge. The well-proven design of the currently used liquid toner container is largely retained in a modified form. The need for complex instrumentation for monitoring the fill level of the liquid toner container is avoided.

In accordance with the invention, an ink jet printer comprises print cartridge means for ejecting droplets of a liquid toner, including a liquid toner container that holds a supply of the liquid toner, a liquid toner printhead in communication with the liquid toner container that receives liquid toner from the liquid toner container and ejects droplets of liquid toner therefrom under command, refill means for adding liquid toner to the interior of the liquid toner container, the refill means communicating from the exterior of the liquid toner container into the interior of the liquid toner container, and evacuation tube means for removing air and liquid toner from the interior of the liquid toner container to the exterior of the liquid toner container; and a service station for resupplying liquid toner to the liquid toner container, including a liquid toner reservoir, means for causing liquid toner to flow from the liquid toner reservoir to the refill means, means for drawing air and liquid toner from the evacuation means, and means for placing the refill means in communication with the ink reservoir and for placing the means for drawing in communication with the evacuation tube means, when the print cartridge is in the service station.

During the resupplying operation, the approach of the present invention is to add liquid toner to the foam within the liquid toner container at one location and simultaneously remove liquid toner and air from another location of the interior of the foam. With this approach, there can never be overfilling that causes leakage of liquid toner or a failure to regulate delivery pressure. The foam within the liquid toner container will gradually fill to a level at which the outflow of liquid toner matches the inflow. The only disadvantage is that some liquid toner may be discarded, but even this can be overcome by filtering the evacuated liquid toner, if necessary, and returning it to the reservoir.

In accordance with the process aspect of the invention, a process for adding liquid toner to the print cartridge of a thermal ink jet printer comprises the steps of furnishing a liquid toner container; introducing liquid toner into the liquid toner container through a refill tube at a refill rate; and simultaneously evacuating air and liquid toner from the interior of the liquid toner container through an evacuation tube at an evacuation rate at least as great as the refill rate.

The approach and apparatus of the invention provide a readily implemented approach to refilling the liquid toner container from an on-board liquid toner reservoir in the printer at intermediate times as the liquid toner is depleted from the container. The positive evacuation of liquid toner and air through the evacuation tube ensures that there cannot be overfilling even through the liquid toner level in the liquid toner container is not monitored during the refill operation. Other features and advantages of the invention will be apparent from the following more detailed description of the preferred embodiment, taken in conjunction with the accompanying drawings, which illustrate, by way of example, the principles of the invention.

DETAILED DESCRIPTION OF THE PREFERRED EMBODIMENT

The present invention provides both a print cartridge and a printer, as well as the procedure for resupplying the print cartridge liquid toner container with liquid toner from a reservoir in the printer. In accordance with the aspect of the invention dealing with the print cartridge, a refillable thermal ink jet print cartridge that ejects droplets of a liquid toner comprises a liquid toner container that holds a supply of the liquid toner; a liquid toner printhead in communication with the liquid toner container that receives liquid toner from the liquid toner container and ejects droplets of liquid toner therefrom under command; refill means for adding liquid toner to the interior of the liquid toner container, the refill means communicating from the exterior of the liquid toner container into the interior of the liquid toner container; and evacuation means for conveying air and liquid toner from the interior of the liquid toner container to the exterior of the liquid toner container.

Figure 1:
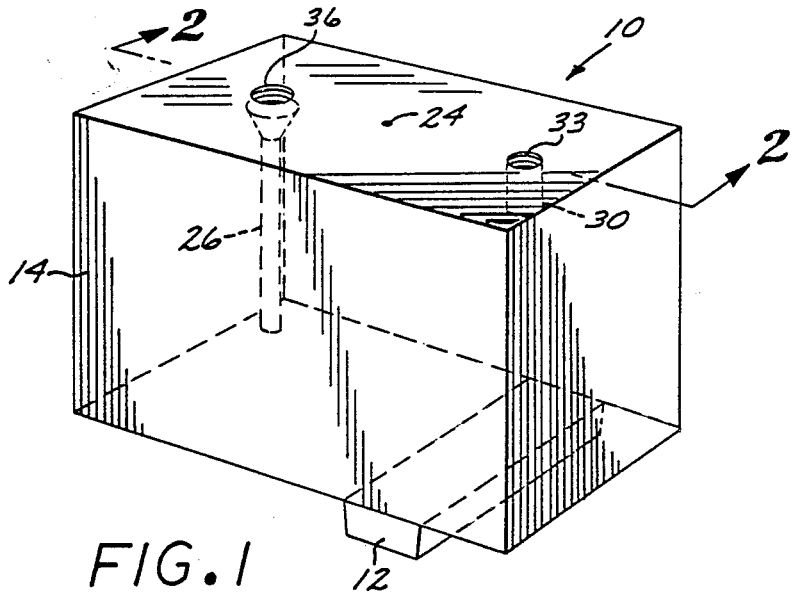
FIG. 1 is a perspective view of an ink jet print cartridge.
Figure 2:
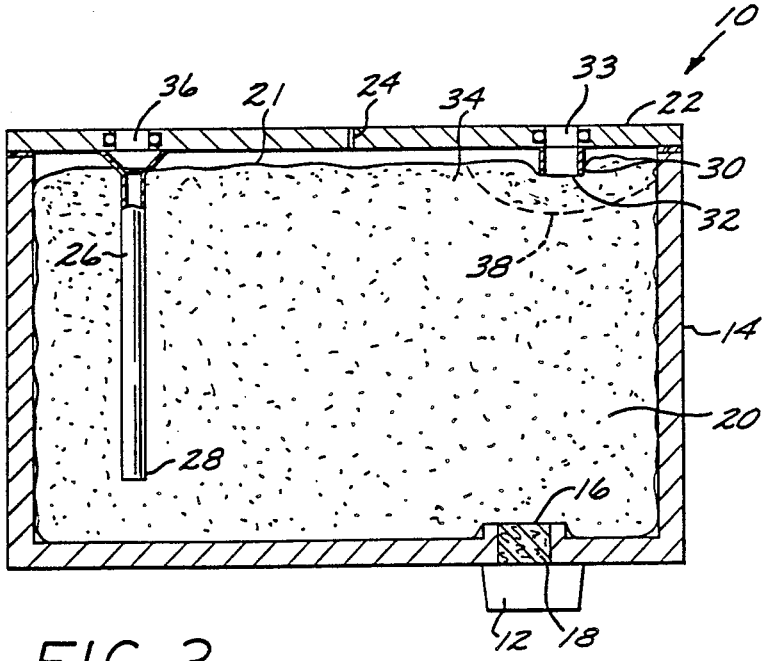
FIG. 2 is a side sectional view of the print cartridge of FIG. 1, taken generally along lines 2—2.

A print cartridge 10, that creates and ejects droplets of liquid toner by vaporization of small bubbles of liquid toner in a precisely controlled manner, is illustrated in FIGS. 1 and 2. The print assembly 10 includes a printhead 12. The printhead 12 includes a plurality of individual nozzles that eject liquid toner toward a printing medium. The operation of the printhead 12 does not form a part of the present invention.

The printhead 12 is supported upon, and may project outwardly from, a liquid toner container 14. The liquid toner container 14 is a hollow rectangular member having at the lower end an outlet 16 with a filter 18, through which liquid toner (also sometimes termed "ink" or "colorant" in the industry) flows from the interior of the container 14 to the printhead 12 at a controlled delivery pressure.

The interior of the container 14 is partially filled with a generally conforming piece 20 of an open cell, reticulated foam. The foam piece 20 is preferably made of polyether polyurethane having 75 pores per inch and felted to three times original density. The foam piece 20 is made in the same general shape as the interior of the container 14, but slightly oversize. The foam piece 20 is therefore in a slight compression after it is inserted into the container 14. The compression, along with a high degree of care taken in inserting the foam piece 20 and filling it with liquid toner, avoids gas pockets within the container 14 after it is charged with liquid toner. By way of example and not of limitation, a typical commercial print cartridge might hold about 20–60 cubic centimeters of liquid toner when fully charged, although the container 14 is not completely filled. An air space 21 is left above the foam piece 20, and the portion of the foam piece 20 adjacent the air space is not saturated with liquid toner. At the factory, liquid toner is introduced under vacuum into the foam with a needle or needles forced into the interior of the foam piece 20, to partially fill the container 14 with liquid toner. Details of the factory filling operation can be found in the publication "Ink Retention in a Color thermal Inkjet Pen" by Erol Erturk, Brian D. Gragg, Mary E. Haviland, W. Wistar Rhoads, Jim L. Ruder, and Joseph E. Scheffelin, published in the Hewlett Packard Journal, August 1988.

After liquid toner is introduced into the foam piece 20 at the factory, a plug 22 is fitted to the body of the container 14, and ultrasonically welded in place. The plug has a vent 24 therethrough, which permits air to flow into the top of the liquid toner container as liquid toner is consumed by ejection and depleted from the foam. The plug 22 also has a refill tube 26 in the form of an elongated hollow needle extending therethrough from the exterior of the container 14 to its interior. A tip 28 of the tube 26 extends downwardly into the body of the foam piece 20. The refill tube 26 is preferably positioned so that its lower tip is near the bottom of the container 14, but not adjacent the filter 18 and outlet 16 supplying the printhead 12.

Also extending through the plug 22 from the exterior of the liquid toner container 14 to its interior is a hollow evacuation tube 30 having an interior end 32 that contacts an upper free surface 34 of the foam piece 20, the free surface 34 being the surface of the foam piece 20 that is in contact with the air space 21. The evacuation tube 30 is preferably dimensioned in length so that an interior end 32 is pushed downwardly against the free surface 34 to place it locally in compression. An exterior end 33 of the evacuation tube 30 and an exterior end of the refill tube 26 are both preferably recessed below the top of the container 14 to reduce the possibility of ink being smeared onto the user's hands or clothing, but optionally extend above the top of the liquid toner container 14.

After the print cartridge 10 has been used for printing, some portion of the originally charged liquid toner will have been consumed, depleting the foam piece 20. The foam piece 20 and the liquid toner container 14 are resupplied as follows. Liquid toner is forced under positive gauge pressure at a volumetric refill rate $R_f$ into the exterior end 36 of the refill tube 26. This liquid toner flows down the interior of the refill tube 26 and out into the foam piece through the refill tube tip 28. A combination of air and liquid toner are simultaneously evacuated from the interior of the liquid toner container 14 under negative gauge pressure through the evacuation tube 30, at a volumetric evacuation rate $R_e$. The vent 24 maintains atmospheric pressure in the air space 21 during this process. It is important that the evacuation rate $R_e$ be imposed on the evacuation tube 30. This is contrasted with, and is different from, the situation where air and liquid toner would be allowed to flow out the evacuation tube 30 at a rate that would simply maintain pressure equilibrium within the container 14.

The invention provides that the volumetric evacuation rate $R_e$ must be equal to or greater than the volumetric refill rate $R_f$. Under this constraint, during a refilling operation the flow of mass out the evacuation tube 26 would initially be mostly air that is displaced from the foam piece 20 as the resupply of liquid toner enters at the rate $R_f$. As the refilling process continues and the foam piece 28 becomes saturated with the resupplied liquid toner, the mass flow out the evacuation tube 26 becomes predominantly liquid toner with, possibly, some bubbles of air. The exact proportion of air and liquid toner is not important, inasmuch as the foam becomes saturated, a self-regulating mechanism occurs which prevents overfilling. Because the interior end 32 of the evacuation tube 30 contacts the free surface 34 of the foam piece 20, the liquid toner is removed nearly completely from a depleted region 38 of the foam piece near the location where the interior end 32 contacts the free surface 34. The free surface 34 is thereby maintained "dry" in the sense that the pores of the foam are not filled with liquid toner in the depleted region 38 (although a film of liquid toner may exist on the surface of the foam cell pores). Ultimately, when the pores of the foam piece 20 become filled except for the depleted region 38, virtually all of the volumetric flow $R_e$ would be liquid toner, and the effect of the refilling operation at that point would be simply to pump liquid toner through the liquid toner container. There could never be overfilling and spillage of the liquid toner, because the refilling rate $R_f$ never exceeds the evacuation rate $R_e$.

The evacuation rate $R_e$ may be substantially equal to the refill rate $R_f$, and the refilling operation proceeds as discussed in the preceding paragraph. However, the evacuation rate $R_e$ is preferably slightly greater than the refill rate $R_f$. In that case, the process is largely as described, with the exception that there is a tendency to form a slight negative pressure within the air space 21. The vent 24 admits air to the air space 21 to equilibrate the pressure to atmospheric. A portion of the flow of air through the vent 24 flows through the air space 21 and the depleted region 38, and thence out of the container 14 through the evacuation tube 30. It is preferable to utilize this mode of operation wherein $R_e$ is slightly greater than $R_f$, because there is certainty that overfilling and spillage of liquid toner cannot occur. Although the approach were $R_e$ is maintained substantially equal to $R_f$ is operable if it is achieved, in a practical commercial setting inexpensive pumps would be used to maintain the volumetric flows $R_e$ and $R_f$, and such pumps might exhibit some degree of variability leading to overfilling.

Figure 3:
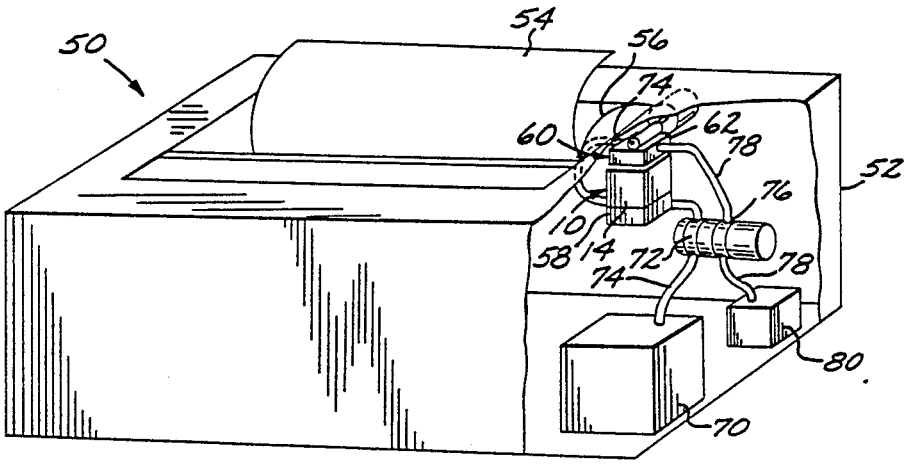
FIG. 3 is a perspective view of an ink jet printer, with portions of the sidewalls removed to illustrate internally mounted components.

The print cartridge and refilling or resupply operation just described are preferably utilized in conjuction with an ink jet printer 50, illustrated in FIG. 3. The printer 50 includes a frame 52, within which a sheet of a printing medium 54 is supported in operable printing relationship to the print cartridge 10, so that the printhead 12 can eject droplets of liquid toner onto the printing medium 54. In one possible embodiment, the printer 50 illustrated in FIG. 3 supports the printing medium 54 on a platen 56 in the manner of a typewriter, advancing the printing medium past the print cartridge 10 by controllably rotating the platen. The print cartridge 10 is supported on a transversely movable carriage 58, that traverses back and forth across the face of the printing medium 54 to print successive swaths of print. In other embodiments, the printing medium may be placed flat and in facing relationship to the cartridge 10. These general features of the printer 50 do not form part of the present invention, and any known type of ink jet printer may be used.

Figure 4:
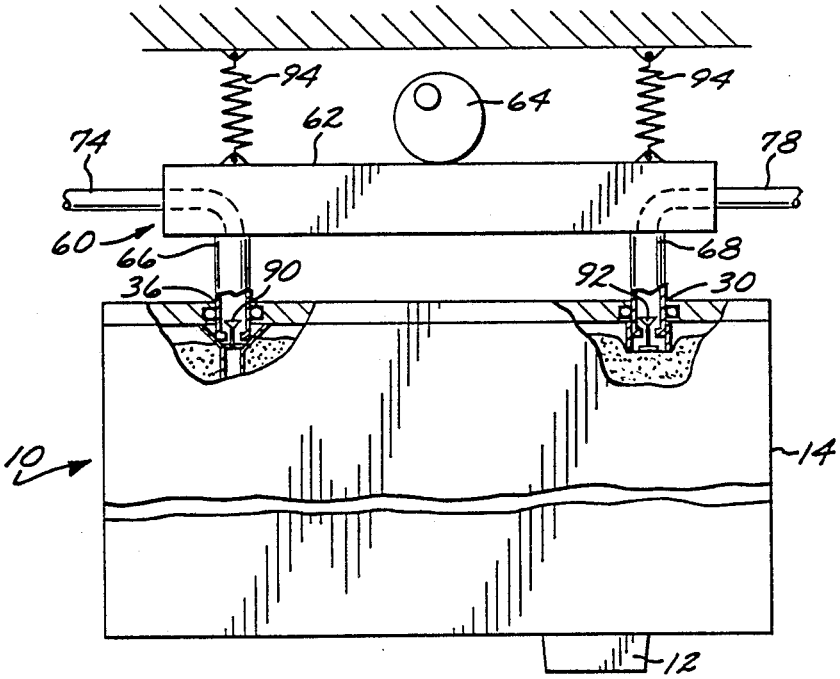
FIG. 4 is an elevational view of the interface portion of the service station.

A feature of the printer 50 that does form part of the present invention is a service station 60, illustrated generally in FIG. 3 and in more specific detail in relation to the print cartridge 10 in FIG. 4. An interface 62 of the service station 60 is located at one end of the traverse of the carriage 58, but within the extent of the traverse so that the cartridge 10 may be moved into facing relationship with the interface 62.

When the print cartridge 10 is so positioned, it is moved into contact with the interface 62 by any convenient mechanism. The preferred mechanism is a cam 64 or pair of cams that rotate under control of a motor or the motion of the carriage 58 to urge the interface 62 into the proper position contacting the print cartridge 10, a vertical downward movement in the view of FIG. 4. FIG. 4 illustrates the cam rotated with interface in an extended position, so that the print cartridge is ready for the resupply operation. Return springs 94 return the interface 62 to a retracted position when the cam 64 is further rotated.

The interface 62 of the service station has a refill fitting 66 disposed and dimensioned to make a leak-free and pressure-tight communication to the exterior end 36 of the refill tube 26, and an evacuation fitting 68 disposed and dimensioned make a leak-free and vacuum-tight communication to the exterior end 33 of the evacuation tube 30, when the print cartridge 10 is in contact with the interface after rotation of the cams 64. These fitting 66 and 68 sealingly fit into the upper ends of the exterior end 36 of the refill tube 26 and the exterior end 33 of the evacuation tube 30 of the print cartridge 10. Poppet valves 90 and 92 close the ends of the fitting 66 and 68, respectively, when the interface 62 is retracted, to prevent dripping and leaks. When the interface 62 is in the extended position with the print cartridge 10 properly located, the valves 90 and 92 are opened so that liquid toner can flow through the refill line 74, and liquid toner and air can flow through the evacuation line 78.

The service station 60 further includes a reservoir 70 of liquid toner supported at a convenient location within the frame 52 of the printer 50. The reservoir 70 is preferably a vented bottle, a similar container, or a collapsible bag containing liquid toner. Liquid toner from the reservoir 70 is pumped by a refill pump 72 through a refill line 74 to the fitting 66, and thence into the foam piece 20 within the liquid toner container 14 in the manner described. Liquid toner and air are removed by an evacuation pump 76 from the fitting 68, through an evacuation line 78 to a dump container 80, where evacuated liquid toner is stored until removal. Alternatively, the evacuated liquid toner could be filtered and returned to the reservoir 70.

The pumps 72 and 76 are termed "volumetric" pumps because they pump a controlled volume of material through the pump in a period of time. The volumetric pump can be a piston pump, which in the case of the present small volumes is preferably a syringe whose plunger can be moved at a precisely controlled rate. Another type of acceptable volumetric pump is a peristaltic pump. Such a peristaltic mechanism works well for the present application, because both the fill pump and the evacuation pump can be constructed on a single motor mechanism, ensuring equal speeds of operation. In this case, the refill line 74 and the evacuation line 78 are placed together into the peristaltic pump. The evacuation line 78 is made with an interior cross sectional area that is the same as, or preferably slightly larger than, the interior cross sectional area of the refill line 74. At any selected operating speed of the pump, the volumetric flow rate $R_e$ through the evacuation line 78 will therefore be the same as (for the case of the equal areas), or greater than (for the case of the larger area), the volumetric flow rate $R_f$ through the refill line 74.

The printer 50 is operated by conducting normal printing operations for a time chosen not to completely deplete the foam piece 20 of liquid toner. The usage of liquid toner can be assessed roughly by counting the number of droplets ejected or the number of pages printed. Before the liquid toner container is depleted of liquid toner, it is moved for resupply of liquid toner to the service station at a convenient time, as when the printer is first turned on or first turned off, or a new page of printing medium is fed. The resupply operation can occur at any time, but it is preferred that it not occur so that the user must wait for it to be completed. The resupply procedure is then accomplished in the manner described, and the printer is returned to service. It will be known from the estimated state of depletion of the liquid toner container approximately how much liquid toner must be added to refill the container, and the resupply procedure can continue to a prescribed additional amount to ensure complete filling. Alternatively, a fixed amount of toner may be pumped into the cartridge during every refill cycle to assure refill under all conditions. Any additional amount of liquid toner above that required for refilling will not result in overfilling, because the excess is conveyed to the dump container in the manner described.

The present invention provides a convenient, inexpensive approach to the resupply of liquid toner in ink jet print cartridges by refilling the foam piece of the printhead container during service. It is a relatively inexpensive addition to the cost of the system and provides significant convenience for the user. It may be used with any color of liquid toner, and a liquid toner resupply capability is readily provided for each of the colors and print cartridges (usually four) of a color printer unit using this approach. Important advantages of a larger liquid toner supply, implemented in this manner, include extending the printhead useful life beyond the quantity of liquid toner that may be carried on board the carriage and increasing the time between replacements of the cartridge. The user thus realizes a lower cost per printed page and greater convenience.

Although a particular embodiment of the invention has been described in detail for purposes of illustration, various modifications may be made without departing from the spirit and scope of the invention. Accordingly, the invention is not to be limited except as by the appended claims.

What is claimed is:

1. An ink jet printer, comprising:

print cartridge means for ejecting droplets of a liquid toner, including a liquid toner container that holds a supply of the liquid toner, a liquid toner printhead in communication with the liquid toner container that receives liquid toner from the liquid toner container and ejects droplets of liquid toner therefrom under command, refill means for adding liquid toner to the interior of the liquid toner container, the refill means communicating from the exterior of the liquid toner container into the interior of the liquid toner container, and evacuation means for removing air and liquid toner from the interior of the liquid toner container to the exterior of the liquid toner container; and a service station for resupplying liquid toner to the liquid toner container, including a liquid toner reservoir, means for causing liquid toner to flow from the ink reservoir to the refill means, the means for causing including a volumetric flow pump that forces a controllable volume flow rate of the liquid toner into the container under a positive gauge pressure, means for drawing air and liquid toner from the evacuation means, the means for drawing including a volumetric flow pump that draws a controllable volume flow rate of air and liquid toner out of the container, and means for placing the refill means in communication with the ink reservoir and for placing the means for drawing in communication with the evacuation tube means, when the print cartridge is in the service station.

2. The ink jet printer of claim 1, wherein the liquid toner container is at least partially filled with a liquid toner-retaining foam piece.

3. The ink jet printer of claim 1, further including a vent to atmosphere in the wall of the liquid toner container.

4. The ink jet printer of claim 1, wherein the printhead is a thermal ink jet printhead.

5. The jet printer of claim 1, wherein the refill means includes a refill tube extending from the exterior of the liquid toner container into its interior, the external end of the refill tube being recessed into the top of the liquid toner container.

6. An ink jet printer operable with print cartridge means for ejecting droplets of a liquid toner, the print cartridge means including a liquid toner container that holds a supply of the liquid toner, an ink printhead that receives liquid toner from the reservoir and ejects droplets of liquid toner therefrom, a refill tube extending from the exterior of the reservoir into the interior of the reservoir, and an evacuation tube communicating from the exterior of the liquid toner container into the interior of the liquid toner container, the printer comprising:

a service station for resupplying liquid toner to the liquid toner container, including a liquid toner reservoir, means for causing liquid toner to flow from the ink reservoir to the refill means, the means for causing including a volumetric flow pump that forces a controllable volume flow rate of the liquid toner into the container under a positive gauge pressure, means for drawing air and liquid toner from the evacuation means, the means for drawing including a volumetric flow pump that draws a controllable volume flow rate of air and liquid toner out of the container, and means for placing the refill means in communication with the ink reservoir and for placing the means for drawing in communication with the evacuation tube means, when the print cartridge is in the service station.

7. The printer of claim 6, wherein the service station further includes disposal means for disposing of the air and liquid toner drawn from the evacuation means.

8. A refillable ink jet print cartridge that ejects droplets of a liquid toner, comprising:

a liquid toner container that holds a supply of the liquid toner, the container having no toner level sensor therein;

a vent to atmosphere in the wall of the liquid toner container;

a liquid toner printhead in communication with the liquid toner container that receives liquid toner from the liquid toner container and ejects droplets of liquid toner therefrom upon command;

refill means for adding liquid toner to the interior of the liquid toner container, the refill means communicating from the exterior of the liquid toner container into the interior of the liquid toner container; and evacuation means for conveying air and liquid toner from the interior of the liquid toner container to the exterior of the liquid toner container, whereby the vent, the refill means, and the evacuation means cooperate to permit refilling of the container without overfilling, and without requiring sensing of the toner level within the container.

9. The cartridge of claim 8, wherein the liquid toner container is at least partially filled with a liquid toner-retaining foam piece.

10. A process for adding liquid toner to the print cartridge of an ink jet printer, comprising the steps of:

furnishing a liquid toner container;

introducing liquid toner into the liquid toner container through a refill tube at a volumetrically controlled refill flow rate; and simultaneously evacuating air and liquid toner from the interior of the liquid toner container through an evacuation tube at a volumetrically controlled evacuation flow rate greater than the refill flow rate, whereby overfilling of the liquid toner container cannot occur inasmuch as air and liquid toner are removed from the interior of the container in the step of evacuating at a rate greater than liquid toner is introduced into the interior of the container in the step of introducing.

11. The process of claim 10, wherein the liquid toner container is at least partially filled with an open-celled foam.

12. The cartridge of claim 11, wherein the evacuation means includes an evacuation tube whose end communicating with the interior of the liquid toner container is pressed against a free surface of the foam piece within the interior of the liquid toner container.

13. An ink jet printer, comprising:

print cartridge means for ejecting droplets of a liquid toner, including a liquid toner container that holds a supply of the liquid toner, the liquid toner container being at least partially filled with a liquid toner-retaining foam piece, a liquid toner printhead in communication with the liquid toner container that receives liquid toner from the liquid toner container and ejects droplets of liquid toner therefrom under command, refill means for adding liquid toner to the interior of the liquid toner container, the refill means communicating from the exterior of the liquid toner container into the interior of the liquid toner container, and evacuation means for removing air and liquid toner from the interior of the liquid toner container to the exterior of the liquid toner container, the evacuation means including an evacuation tube whose end communicating with the interior of the liquid toner container is pressed against a free surface of the foam piece within the interior of the liquid toner container; and a service station for resupplying liquid toner to the liquid toner container, including a liquid toner reservoir, means for causing liquid toner to flow from the ink reservoir to the refill means, means for drawing air and liquid toner from the evacuation means, and means for placing the refill means in communication with the ink reservoir and for placing the means for drawing in communication with the evacuation tube means, when the print cartridge is in the service station.

14. The printer of claim 13, wherein the means for causing includes a volumetric flow pump.

15. The printer of claim 13, wherein the means for drawing includes a volumetric flow pump.

16. The printer of claim 13, wherein the liquid toner container has a vent to atmosphere in the wall thereof.

17. A refillable thermal ink jet print cartridge that ejects droplets of a liquid toner, comprising:

a liquid toner container that holds a supply of the liquid toner, wherein the liquid toner container is at least partially filled with a liquid toner-retaining foam piece;

a liquid toner printhead in communication with the liquid toner container that receives liquid toner from the liquid toner container and ejects droplets of liquid toner therefrom under command;

refill means for adding liquid toner to the interior of the liquid toner container, the refill means communicating from the exterior of the liquid toner container into the interior of the liquid toner container; and evacuation means for conveying air and liquid toner from the interior of the liquid toner container to the exterior of the liquid toner container, wherein the evacuation means includes an evacuation tube whose end communicating with the interior of the liquid toner container is pressed against a free surface of the foam piece within the interior of the liquid toner container.

18. The cartridge of claim 17, wherein the liquid toner container has a vent to atmosphere in the wall thereof.

* * * * *